US006375418B1

(12) United States Patent
Watanabe et al.

(10) Patent No.: US 6,375,418 B1
(45) Date of Patent: Apr. 23, 2002

(54) HEAT SINK-EQUIPPED COOLING APPARATUS

(75) Inventors: Michinori Watanabe; Michihiro Suzuki, both of Tokyo (JP)

(73) Assignee: Sanyo Denki Co., Ltd., Tokyo (JP)

( * ) Notice: Subject to any disclaimer, the term of this patent is extended or adjusted under 35 U.S.C. 154(b) by 0 days.

(21) Appl. No.: 09/702,396

(22) Filed: Oct. 31, 2000

(30) Foreign Application Priority Data

Nov. 29, 1999 (JP) ..... 11-337489

(51) Int. Cl.[7] ..... F04D 29/58

(52) U.S. Cl. ..... 415/178; 415/213.1; 415/214.1; 415/221; 361/697

(58) Field of Search ..... 415/176, 178, 415/213.1, 214.1, 221; 416/244 R; 361/695, 697; 165/80.3, 122, 125, 185

(56) References Cited

U.S. PATENT DOCUMENTS 5,484,013 A * 1/1996 Morikawa et al. ..... 165/80.3
5,615,998 A 4/1997 Kodama et al.
5,629,834 A * 5/1997 Kodama et al. ..... 361/695
D403,760 S 1/1999 Kodaira et al.
5,910,694 A 6/1999 Yokozawa et al.
6,132,170 A * 10/2000 Horng ..... 415/178

* cited by examiner

*Primary Examiner*—Edward K. Look
*Assistant Examiner*—Ninh Nguyen
(74) *Attorney, Agent, or Firm*—Rankin, Hill, Porter & Clark LLP

(57) ABSTRACT

A heat sink-equipped cooling apparatus capable of increasing a size of an air discharge port as compared with a prior art. A fan unit is mounted on a heat sink. The heat sink includes a base formed into a contour having first and second sides defined so that an angle therebetween is substantially 90 degrees. A side wall of the base and a casing of the fan unit cooperate with each other to provide an air discharge port at a position corresponding to sides of the base opposite to the first and second sides while being combined with each other. The air discharge port is constructed so as to permit air sucked through an opening to be discharged therethrough.

14 Claims, 4 Drawing Sheets

HEAT SINK-EQUIPPED COOLING APPARATUS

BACKGROUND OF THE INVENTION

This invention relates to a cooling apparatus equipped with a heat sink or a heat sink-equipped cooling apparatus which is adapted to directly or indirectly cool an electronic component such as an MPU or the like, and more particularly to a cooling apparatus for positively cooling a heat sink by means of air fed from a fan unit.

An electronic component cooling apparatus which includes a combination of a heat sink and a fan unit has been conventionally known in the art as disclosed in U.S. Pat. Nos. 5,910,694, 5,615,998 or the like.

Typically, a conventional electronic component cooling apparatus is so constructed that air discharged from a fan unit and heated by thermal energy dissipated from radiation fins is exhausted in all directions from a whole periphery of a heat sink, as disclosed in U.S. Pat. No. 5,615,998 or the like.

Whereas, U.S. Pat. No. 5,910,694 discloses a cooling apparatus configured so as to discharge air from one side of a heat sink, as shown in FIGS. 9 to 11 of the patent.

Also, U.S. Pat. No. 5,615,998 and U.S. Design Pat. No. 403,760 each disclose an electronic component cooling apparatus including an engagement structure which permits engagement between a plurality of engaging sections provided on a casing of a fan unit and a plurality of engaged sections provided on a heat sink by merely approaching the casing of the fan unit to the heat sink.

In the cooling apparatus including the heat sink disclosed in U.S. Pat. No. 5,910,694 described above, the heat sink includes a base formed into a substantially rectangular shape. The cooling apparatus includes an air discharge port arranged in a manner to positionally correspond to one side of the heat sink. The direction in which the air discharge port is arranged is limited in view of the case that parts which do not like to be exposed to hot air are arranged around a cooling apparatus, the case that hot air is discharged to an outside of a casing of an electronic equipment, or the like.

However, such a conventional structure fails to increase a size of the air discharge port, to thereby increase the amount of air discharged. Also, it substantially fails to reduce a size of the base of the heat sink, to thereby compactly configure the cooling apparatus.

SUMMARY OF THE INVENTION

The present invention has been made in view of the foregoing disadvantage of the prior art.

Accordingly, it is an object of the present invention to provide a heat sink-equipped cooling apparatus which is capable of significantly increase a size of an air discharge port, as compared with the prior art.

It is another object of the present invention to provide a heat sink-equipped cooling apparatus which is capable of reducing a size of a base of a heat sink as compared with the prior art.

In accordance with the present invention, a cooling apparatus is provided. The cooling apparatus includes a heat sink including a base formed into a contour having a plurality of sides which include a first side and a second side defined so that an angle therebetween is about 90 degrees. The base also includes a side wall defined so as to be raised from the base and continuously extend along at least the first and second sides. The cooling apparatus also includes a fan unit mounted on the heat sink while being arranged on a side of the heat sink on which the side wall is raised. The heat sink may be provided with radiation fins as desired.

The fan unit includes an impeller provided with a plurality of blades, a motor including a housing, a revolving shaft and a rotor fixed on the revolving shaft and arranged so as to rotate the impeller mounted on the rotor, a casing provided with an opening in which the impeller and motor are received, and a plurality of webs for connecting the housing of the motor and the casing to each other therethrough so as to position the motor at a central portion of the opening.

The side wall of the heat sink and the casing of the fan unit cooperate with each other to provide an air discharge port at a position corresponding to at least one side of the base opposite to the first and second sides while being combined with each other. The air discharge port is constructed so as to permit air sucked through the opening to be discharged therethrough.

The above-described construction of the present invention, when the base is configured into a substantially rectangular shape, permits the air discharge port to be formed at a position corresponding to other two sides opposite to the first and second sides, so that the air discharge port may be increased in size as compared with the prior art.

Also, the above-described construction of the present invention, when the air discharge port is arranged at a position corresponding to one side, permits each of the first and second sides to be arranged at a position opposite to the air discharge port, so that the heat sink may be configured at a portion thereof at which the first and second sides are positioned into a reduced size.

In a preferred embodiment of the present invention, the contour of the base has third and fourth sides defined on a side of the air discharge port and arranged adjacent to the first and second sides, respectively, and the side wall is integrally provided with a pair of extensions so as to respectively extend along the third and fourth sides. This permits a size of the air discharge port to be determined as desired by forming each of the extensions into a desired length and a desired configuration.

In a preferred embodiment of the present invention, the extensions each are formed with an held portion and the casing is integrally provided with a pair of hooks each held in the held portion. This permits the fan unit to be fixed on the heat sink by merely holding the hooks in the held portions.

In a preferred embodiment of the present invention, the base of the heat sink has a fifth side defined so as to be contiguous to the first and second sides, to thereby connect the first and second sides to each other therethrough. This permits a configuration of the base to be further reduced.

In a preferred embodiment of the present invention, the base has a sixth side and a seventh side defined so as to be respectively contiguous to the third and fourth sides and permit an angle between the first side and the second side to be about 90 degrees. This permits the air discharge port to be arranged at a position corresponding to the sixth and seventh sides, resulting in a size of the air discharge port being about twice as large as that of the prior art.

In a preferred embodiment of the present invention, the contour of the base has a sixth side defined so as to be contiguous to the third and fourth sides and extend substantially in parallel to the fifth side. Such construction permits the air discharge port to be arranged at a position corresponding to the six side. This results in a configuration of the base and a side thereof to be reduced as compared with the prior art.

In a preferred embodiment of the present invention, the casing of the fan unit is formed into substantially the same contour as the contour of the base, resulting in having first to fifth sides corresponding to the first to fifth sides of the base. One of the webs is formed so as to extend toward the fifth side of the casing. The one web has a conductor for feeding of electric power to said motor received therein. Such configuration permits the conductor to be led out of a side opposite to the air discharge port, to thereby facilitate mounting the cooling apparatus in a casing of an electronic equipment.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
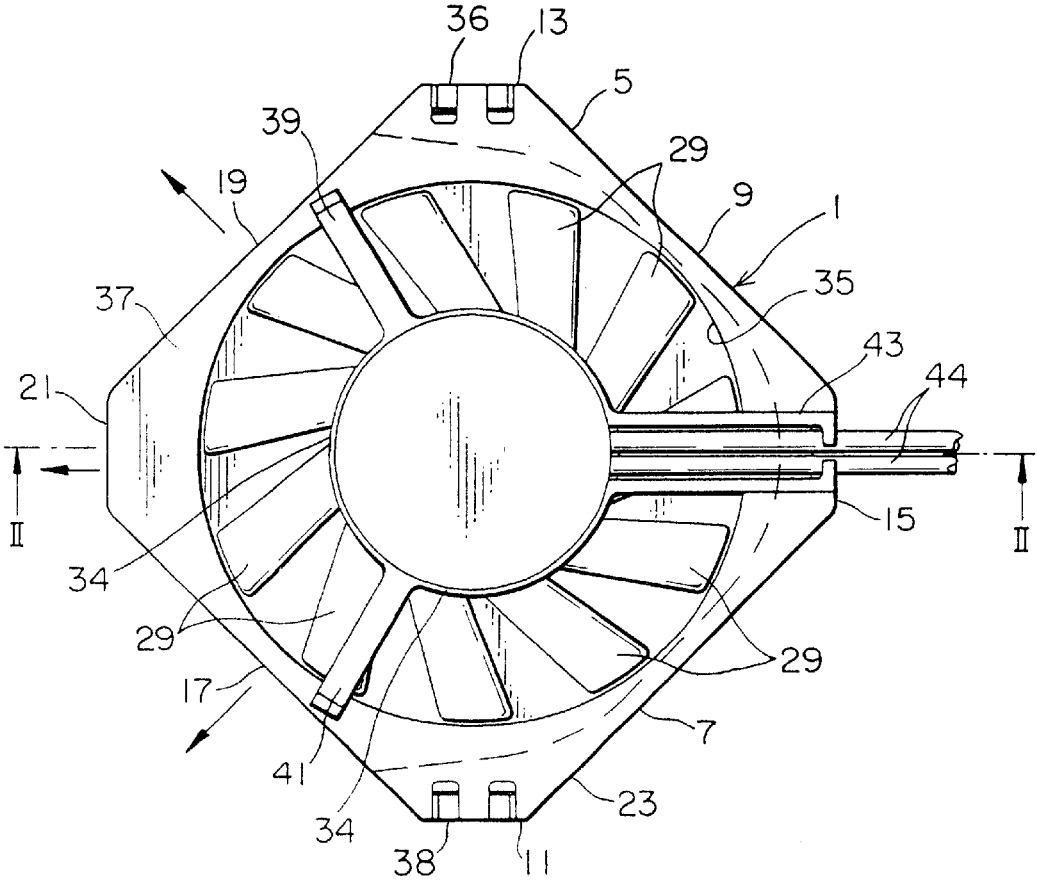
FIG. 1 is a front elevation view showing an embodiment of a heat sink-equipped cooling apparatus according to the present invention.

Now, a cooling apparatus equipped with a heat sink or a heat sink-equipped cooling apparatus according to the present invention will be described with reference to the accompanying drawings.

Referring first to FIGS. 1 to 3C, an embodiment of a heat sink-equipped cooling apparatus according to the present invention is illustrated. In FIGS. 1 to 3C, reference numeral 1 generally designates a heat sink-equipped cooling apparatus which is constructed so as to directly cool a member or component to be cooled such as an MPU (electronic component), a heat pipe or the like or outwardly discharge air in a casing of an electronic equipment to cool an interior of the casing. Reference numeral 3 designates a heat sink made of aluminum and 5 is a fan unit constituted by an axial fan. The cooling apparatus 1 of the illustrated embodiment is so configured that the fan unit 5 is mounted on the heat sink 3.

Figure 3A:
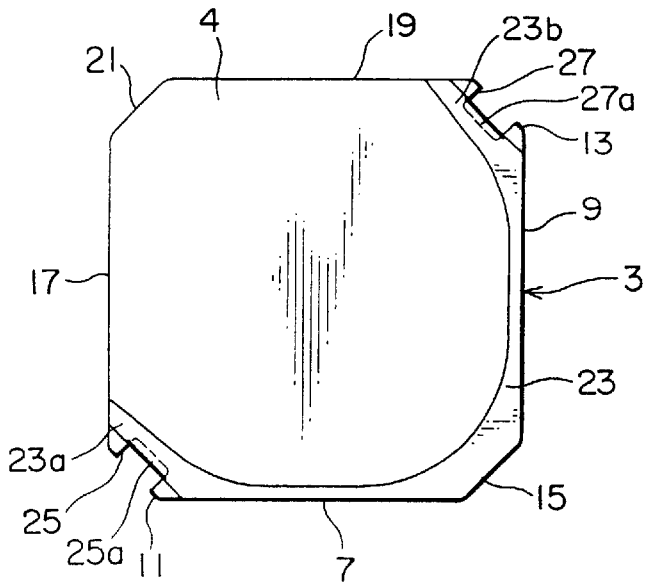
FIG. 3A is a front elevation view showing a heat sink which may be incorporated in the cooling apparatus shown in FIG. 1.
Figure 3B:
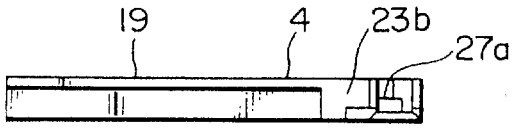
FIG. 3B is a plan view of the heat sink shown in FIG. 3A.
Figure 3C:
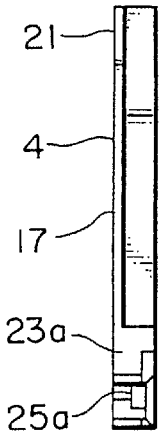
FIG. 3C is a left side elevation view of the heat sink shown in FIG. 3A.
Figure 4:
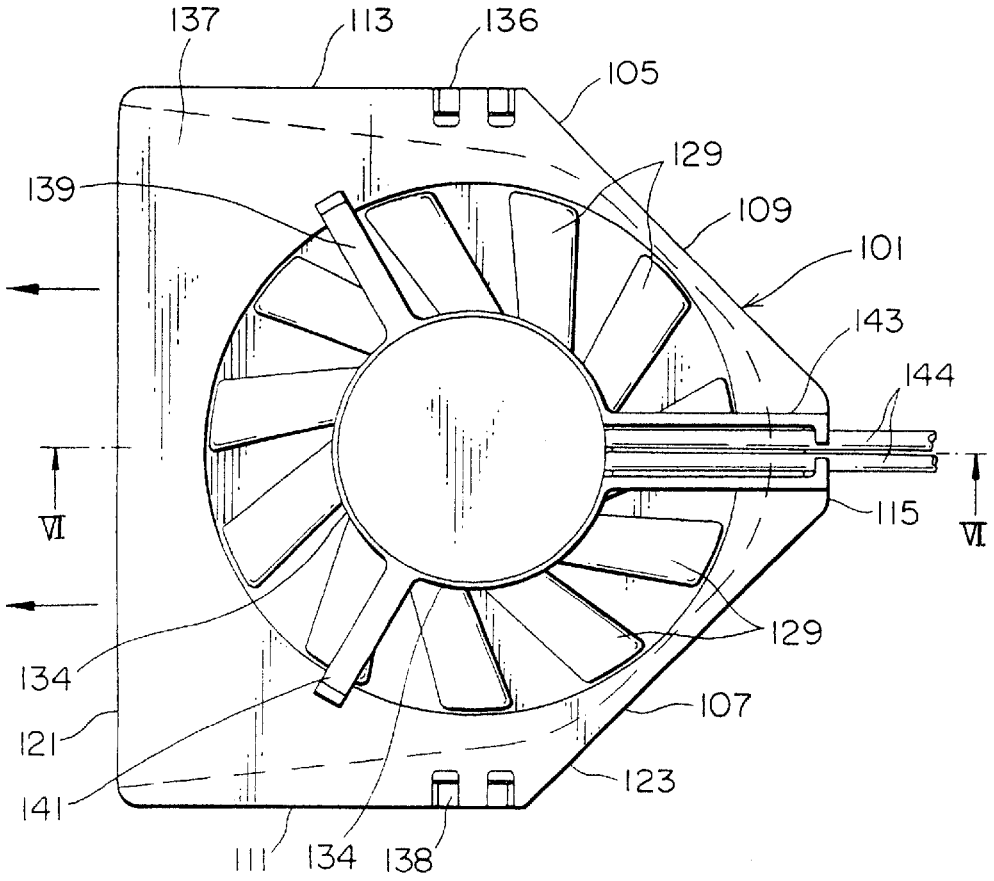
FIG. 4 is a front elevation view showing another embodiment of a heat sink-equipped cooling apparatus according to the present invention.
Figure 5:
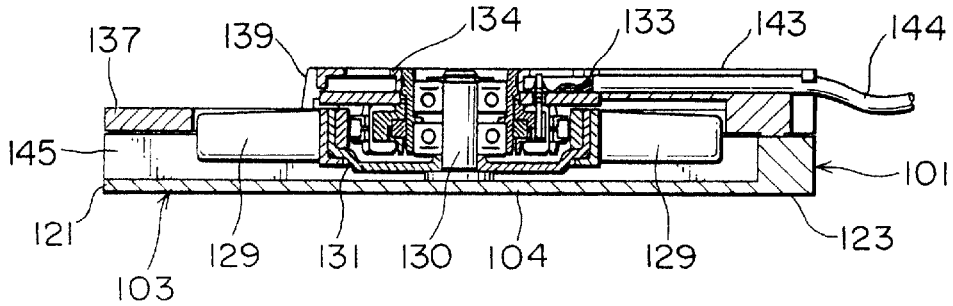
FIG. 5 is a sectional view taken along line VI—VI of FIG. 4.
Figure 6A:
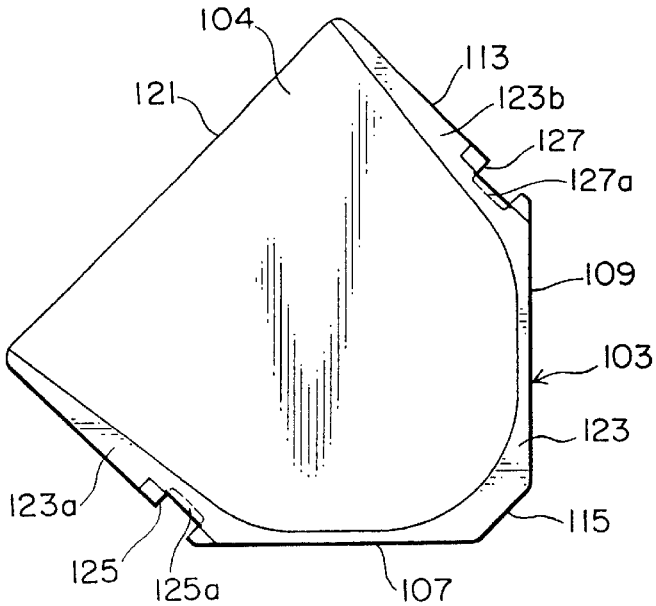
FIG. 6A is a front elevation view showing a heat sink which may be incorporated in the cooling apparatus shown in FIG. 4.
Figure 6B:
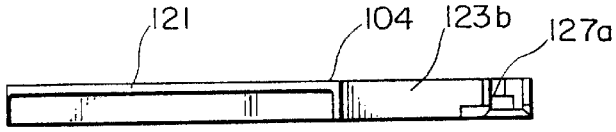
FIG. 6B is a plan view of the heat sink shown in FIG. 6A.
Figure 6C:
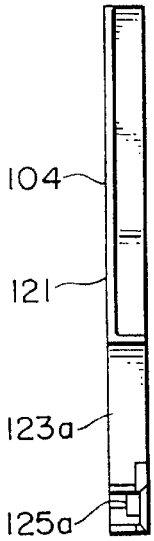
FIG. 6C is a left side elevation view of the heat sink shown in FIG. 6A.

The heat sink 3, as shown in FIG. 3, includes a base 4 having eight sides including a first side 7 and a second side 9. More particularly, the first and second sides 7 and 9 are formed so as to define an angle of about 90 degrees therebetween. The angle is ideally 90 degrees. The base 4 also has a third side 11 and a fourth side 13 defined adjacently to the first side 7 and second side 9, respectively. Also, the base 4 has a fifth side 15 defined between the first side 7 and the second side 9 so as to connect the first and second sides to each other therethrough. In addition, the base 4 has a sixth side 17 and a seventh side 19 defined opposite to the first side 7 and second side 9, respectively, with an angle of 90 degrees being defined therebetween. The sixth side 17 and seventh side 19 are connected to each other through an eighth side 21 defined therebetween.

The heat sink 3 also includes a side wall 23 formed integrally with the base 4 in a manner to be raised from the base 4 and continuously extend along the first and second sides 7 and 9. The side wall 23 has a pair of extensions 23*a* and 23*b* provided integrally therewith so as to extend along the third side 11 and fourth side 13, respectively. The third side 11 and fourth side 13 are formed with held portions 25 and 27 in which hooks provided on a casing of the fan unit 5 described hereinafter are held, respectively. The held portions 25 and 27 have holding surfaces 25*a* and 27*a* formed so as to extend in a direction parallel to a direction in which the base 4 extends, respectively.

Figure 2:
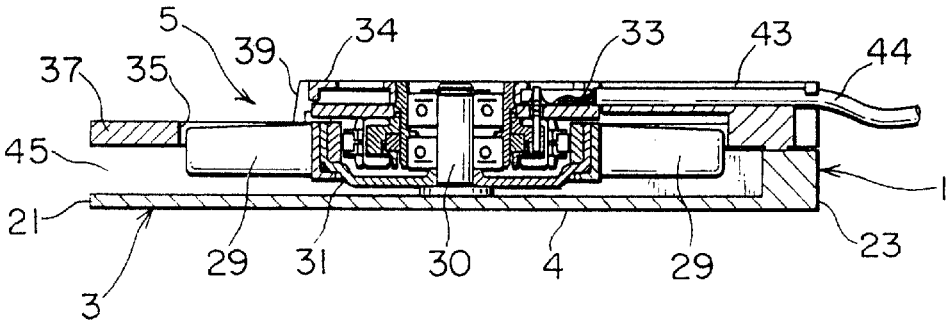
FIG. 2 is a sectional view taken along line II—II of FIG. 1.

The fan unit 5, as shown in FIGS. 1 and 2, includes an impeller 31 having eleven blades 29, a motor 33 including a revolving shaft 30 on which the impeller 31 is fixed and driven for rotating the impeller 31, a housing 34 for the motor 33, a casing 37 provided with a suction opening 35 in which the impeller 31 and motor 33 are received, and three webs 39, 41 and 43 for connecting the housing 34 of the motor 33 and the casing 37 to each other therethrough so as to position the motor 33 at a central portion of the suction opening 35. The casing 37 of the fan unit 5 is formed into substantially the same outer configuration as that of the base 4 as viewed from a front side of the fan unit 5, resulting in having first to eighth sides respectively corresponding to the first to eighth sides 7 to 21. The web 43 is arranged so as to extend toward the fifth side of the casing 37 corresponding to the fifth side 15 of the base 4. The web 43 has a cable 44 for feeding electric power to the motor 33 received therein. Such arrangement permits the cable 44 to be led out of a side opposite to an air discharge port 45.

In the illustrated embodiment, the casing 37, the housing 34 of the motor 33 and the webs 39 to 43 are integrally formed of a molding material mainly consisting of a synthetic resin material. The motor includes an internal structure which may be constructed as disclosed in Japanese Patent Application Laid-Open Publication No. 83873/1996.

The blades 29 of the impeller 31 are constructed so as to suck air from an axial direction of the revolving shaft of the motor 33 through the suction opening 35 toward the base 4 and then positively discharge the sucked air in a radial direction of the revolving shaft 30 of the motor 33. The fan is constituted by an axial fan, so that a part of air sucked is permitted to flow in the axial direction or toward the base 4.

The casing 37 is formed into a flat shape so as to be opposite to a front surface of the base 4 of the heat sink 3 while being spaced therefrom at a predetermined interval. The side wall 23 provided on the base 4 and the casing 37 of the fan unit 5 cooperate with each other to form an air discharge port 45 for discharging air sucked through the opening at a portion thereof corresponding to the sixth to eighth sides 17 to 21 opposite to the first and second sides 7 and 9 of the base 4 while being combined with each other. The casing 37 is integrally provided with a pair of hooks 36 and 38 held on the holding surfaces 25*a* and 27*a* of the held portions 25 and 27 formed on the side wall 23 of the heat sink 3. Such a holding structure using hooks is disclosed in U.S. Pat. No. 5,615,998 or the like.

Thus, air blown out of the blades 29 being rotated is flowed along the side wall 23 and then discharged from the air discharge port 45. Directions in which air discharged from the heat sink 3 is flowed are indicated at arrows in FIG. 1.

Referring now to FIGS. 4 to 6C, another embodiment of a heat sink-equipped cooling apparatus according to the present invention is illustrated. In connection with the illustrated embodiment, reference numerals correspond to those discussed in the embodiment described above with reference to FIGS. 1 to 3C, except with an additional prefix of 100. In the illustrated embodiment, a heat sink 103 includes a base 104 formed into a configuration like a home plate of a baseball. The base 104 of the heat sink 103 has a third side 111 and a fourth side 113 formed into a larger length and a sixth side 121 arranged so as to connect the third and fourth sides 111 and 113 to each other therethrough and be opposite to a fifth side 115.

In the illustrated embodiment, an air discharge port 145 is formed at a portion of the heat sink 103 corresponding to the sixth side 121. Such arrangement of the air discharge port 145 permits the base 104 to be formed into an increased size as compared with the prior art, although it fails to form the air discharge port 145 into a highly increased size.

As can be seen from the foregoing, the present invention, when the base is configured into a substantially rectangular shape, permits the air discharge port to be formed at a position corresponding to other sides opposite to the first and second sides, so that the air discharge port may be increased in size as compared with the prior art. Also, the present invention, when the air discharge port is arranged at a position corresponding to one side, permits each of the first and second sides to be arranged at a position opposite to the air discharge port, so that the heat sink may be configured at a portion thereof at which the first and second sides are positioned into a reduced size.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A cooling apparatus comprising:

a heat sink including a base formed into a contour having a plurality of sides which include a first side and a second side defined so that an angle therebetween is about 90 degrees;

said heat sink also including a side wall defined so as to be raised from said base and continuously extend along at least said first and second sides; and a fan unit mounted on said heat sink while being arranged on a side of said heat sink on which said side wall is raised;

said fan unit including an impeller provided with a plurality of blades, a motor including a housing, a revolving shaft and a rotor fixed on said revolving shaft and arranged so as to rotate said impeller mounted on said rotor, a casing provided with an opening in which said impeller and motor are received, and a plurality of webs for connecting said housing of said motor and said casing to each other therethrough so as to position said motor at a central portion of said opening;

said side wall of said heat sink and said casing of said fan unit cooperating with each other to provide an air discharge port at a position corresponding to at least one side of said base opposite to said first and second sides while being combined with each other;

said air discharge port being constructed so as to permit air sucked through said opening to be discharged therethrough.

2. A cooling apparatus as defined in claim 1, wherein said contour of said base has third and fourth sides defined on a side of said air discharge port and arranged adjacent to said first and second sides, respectively; and said side wall is integrally provided with a pair of extensions so as to respectively extend along said third and fourth sides.

3. A cooling apparatus as defined in claim 2, wherein said extensions each are formed with an held portion;

said casing is integrally provided with a pair of hooks each held in said held portion; and said fan unit is fixed on said heat sink while said hooks each are kept held in said held portion.

4. A cooling apparatus as defined in claim 3, wherein said base has a sixth side and a seventh side defined so as to be respectively contiguous to said third and fourth sides and permit an angle between said first side and said second side to be about 90 degrees.

5. A cooling apparatus as defined in claim 2, wherein said base has a fifth side defined so as to be contiguous to said first and second sides, to thereby connect said first and second sides to each other therethrough.

6. A cooling apparatus as defined in claim 4, wherein said contour of said base has a sixth side defined so as to be contiguous to said third and fourth sides and extend substantially in parallel to said fifth side.

7. A cooling apparatus as defined in claim 4, wherein said casing of said fan unit is formed into a substantially identical contour with said contour of said base, resulting in having first to fifth sides corresponding to said first to fifth sides of said base; and one of said webs is formed so as to extend toward said fifth side of said casing;

said one web has a conductor for feeding of electric power to said motor received therein.

8. A cooling apparatus as defined in claim 5, wherein said base has a sixth side and a seventh side defined so as to be respectively contiguous to said third and fourth sides and permit an angle between said first side and said second side to be about 90 degrees.

9. A cooling apparatus as defined in claim 2, wherein said base has a sixth side and a seventh side defined so as to be respectively contiguous to said third and fourth sides and permit an angle between said first side and said second side to be about 90 degrees.

10. A cooling apparatus as defined in claim 1, wherein said base has a sixth side and a seventh side defined so as to be respectively contiguous to said third and fourth sides and permit an angle between said first side and said second side to be about 90 degrees.

11. A cooling apparatus comprising:

a heat sink including a base formed into a contour having a first side and a second side defined so that an angle therebetween is about 90 degrees, a third side and a fourth side respectively defined so as to be adjacent to said first side and second side, a fifth side defined so as to be contiguous to said first and second sides to connect said first and second sides to each other therethrough, a sixth side and a seventh side defined so that an angle between said first side and said second side is about 90 degrees, and an eighth side defined so as to be contiguous to said sixth and seventh sides to connect said sixth and seventh sides to each other therethrough;

said heat sink also including a side wall arranged so as to be raised from said base and continuously extend along said first to fifth sides; and a fan unit mounted on said heat sink while being arranged on a side of said heat sink on which said side wall is raised;

said fan unit including an impeller provided with a plurality of blades, a motor including a housing, a revolving shaft and a rotor fixed on said revolving shaft and arranged so as to rotate said impeller mounted on said rotor, a casing provided with an opening in which said impeller and motor are received, and a plurality of webs for connecting said housing of said motor and said casing to each other therethrough so as to position said motor at a central portion of said opening;

said side wall of said heat sink and said casing of said fan unit cooperating with each other to provide an air discharge port at a position corresponding to said sixth to eighth sides opposite to said first, second and fifth sides while being combined with each other;

said air discharge port being constructed so as to permit air sucked through said opening to be discharged therethrough.

12. A cooling apparatus as defined in claim 11, wherein said side wall is formed at portions thereof corresponding to said third and fourth sides with a pair of held portions;

said casing is integrally provided with a pair of hooks held in said held portions, respectively; and said fan unit is fixed on said heat sink while said hooks are held in said held portions.

13. A cooling apparatus comprising:

a heat sink including a base formed into a contour having a first side and a second side defined so that an angle therebetween is about 90 degrees, a third side and a fourth side respectively defined so as to be adjacent to said first side and second side, and a sixth side defined so as to be contiguous to said third and fourth sides and extend substantially in parallel to said fifth side;

said heat sink also including a side wall arranged so as to be raised from said base and continuously extend along said first to fifth sides; and a fan unit mounted on said heat sink while being arranged on a side of said heat sink on which said side wall is raised;

said fan unit including an impeller provided with a plurality of blades, a motor including a housing, a revolving shaft and a rotor fixed on said revolving shaft and arranged so as to rotate said impeller mounted on said rotor, a casing provided with an opening in which said impeller and motor are received, and a plurality of webs for connecting said housing of said motor and said casing to each other therethrough so as to position said motor at a central portion of said opening;

said side wall of said heat sink and said casing of said fan unit cooperating with each other to provide an air discharge port at a position corresponding to said fifth side while being combined with each other;

said air discharge port being constructed so as to permit air sucked through said opening to be discharged therethrough.

14. A cooling apparatus as defined in claim 13, wherein said side wall is formed at portions thereof corresponding to said third and fourth sides with a pair of held portions;

said casing is integrally provided with a pair of hooks held in said held portions, respectively; and said fan unit is fixed on said heat sink while said hooks are held in said held portions.

* * * * *